US011164537B2

(12) United States Patent
Wang et al.

(10) Patent No.: US 11,164,537 B2
(45) Date of Patent: Nov. 2, 2021

(54) BOOSTER CIRCUIT, SHUTDOWN CIRCUIT, METHODS FOR DRIVING THE SAME, AND DISPLAY APPARATUS

(71) Applicants: HEFEI BOE DISPLAY TECHNOLOGY CO., LTD., Hefei (CN); BOE TECHNOLOGY GROUP CO., LTD., Beijing (CN)

(72) Inventors: Huiming Wang, Beijing (CN); Jing Ma, Beijing (CN); Rongcheng Liu, Beijing (CN); Xiuqin Yang, Beijing (CN); Peng Zhao, Beijing (CN); Yanwei Lv, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/768,868

(22) PCT Filed: Dec. 19, 2019

(86) PCT No.: PCT/CN2019/126471

§ 371 (c)(1),
(2) Date: Jun. 1, 2020

(87) PCT Pub. No.: WO2020/173189

PCT Pub. Date: Sep. 3, 2020

(65) Prior Publication Data

US 2021/0210044 A1 Jul. 8, 2021

(30) Foreign Application Priority Data

Feb. 26, 2019 (CN) ..... 201910144279.3

(51) Int. Cl.
*G09G 3/36* (2006.01)

(52) U.S. Cl.
CPC ..... *G09G 3/3696* (2013.01); *G09G 3/3688* (2013.01); *G09G 2330/027* (2013.01)

(58) Field of Classification Search
CPC ..... G09G 3/3696; G09G 3/3688; G09G 2330/027; G09G 5/00; G09G 3/3674;
(Continued)

(56) References Cited

U.S. PATENT DOCUMENTS 6,147,923 A * 11/2000 Nakano ..... G11C 5/145 365/102
6,333,738 B1 12/2001 Ide
(Continued)

FOREIGN PATENT DOCUMENTS

CN 1801303 A 7/2006
CN 103208246 A 7/2013
(Continued)

OTHER PUBLICATIONS

International Search Report and Written Opinion dated Mar. 20, 2020, for corresponding PCT Application No. PCT/CN2019/126471.
(Continued)

*Primary Examiner* — Kent W Chang
*Assistant Examiner* — Sujit Shah
(74) *Attorney, Agent, or Firm* — Kinney & Lange, P.A.

(57) ABSTRACT

The embodiments of the present disclosure propose a booster circuit and a method for driving the same, a shutdown circuit and a method for driving the same, and a display apparatus. The booster circuit includes a first input sub-circuit coupled to a first input signal terminal, a first voltage signal terminal, and an output signal terminal, and configured to transmit a first voltage signal at the first voltage signal terminal to the output signal terminal under control of a first input signal at the first input signal terminal;
(Continued)

a second input sub-circuit coupled to a second input signal terminal, the first voltage signal terminal and a first node, and configured to transmit the first voltage signal at the first voltage signal terminal to the first node under control of a second input signal at the second input signal terminal; and a first storage sub-circuit coupled to the output signal terminal and the first node, and configured to cause a level of an output signal at the output signal terminal to be raised to a level higher than the first voltage signal.

16 Claims, 11 Drawing Sheets

(58) Field of Classification Search
CPC .. G09G 3/3677; G09G 3/3681; G09G 3/3692; G09G 3/364; G09G 3/3266; G09G 3/3275; G09G 3/3283
See application file for complete search history.

(56) References Cited

U.S. PATENT DOCUMENTS

| | | | | |
|---|---|---|---|---|
| 10,438,546 | B2 | 10/2019 | Yang et al. | |
| 10,482,826 | B2 | 11/2019 | Shi | |
| 10,692,464 | B2 | 6/2020 | Yang et al. | |
| 2008/0084410 | A1* | 4/2008 | Uehara | G09G 3/3655 345/211 |
| 2008/0266228 | A1* | 10/2008 | Ueno | H02M 3/07 345/89 |
| 2012/0274304 | A1* | 11/2012 | Lin | H02M 3/158 323/311 |
| 2013/0177128 | A1 | 7/2013 | Ko et al. | |
| 2014/0192095 | A1* | 7/2014 | Liao | G09G 3/3696 345/690 |

FOREIGN PATENT DOCUMENTS

| | | | |
|---|---|---|---|
| CN | 105845069 | A | 8/2016 |
| CN | 106652872 | A | 5/2017 |
| CN | 207425330 | U | 5/2018 |
| CN | 108172157 | A | 6/2018 |
| CN | 207781164 | U | 8/2018 |
| CN | 108732839 | A | 11/2018 |
| CN | 208158417 | U | 11/2018 |
| CN | 109215601 | A | 1/2019 |
| CN | 109671413 | A | 4/2019 |
| JP | 3568098 | B2 | 9/2004 |

OTHER PUBLICATIONS

First Chinese Office Action dated Feb. 3, 2020, for corresponding Chinese Application No. 201910144279.3.
Second Chinese Office Action dated Jul. 23, 2020, for corresponding Chinese Application No. 201910144279.3.

* cited by examiner

BOOSTER CIRCUIT, SHUTDOWN CIRCUIT, METHODS FOR DRIVING THE SAME, AND DISPLAY APPARATUS

CROSS-REFERENCE TO RELATED APPLICATION(S)

This application is a Section 371 National Stage Application of International Application No. PCT/CN2019/126471, filed Dec. 19, 2019, which in turn claims priority to the Chinese Patent Application No. 201910144279.3, filed on Feb. 26, 2019, which is incorporated herein by reference in its entirety.

TECHNICAL FIELD

The present disclosure generally relates to the field of display technology, and more specifically, to a booster circuit, a shutdown circuit, methods for driving the same, and a display apparatus.

BACKGROUND

With the increasing production of large-size and high-definition liquid crystal panels, the quality of displays themselves is constantly being improved. However, the large-size and high-definition liquid crystal panels have a heavy image load, which causes an afterimage phenomenon when the displays are shut down.

For example, when a liquid crystal display is shut down, in order to allow charges stored in a pixel storage capacitor and a parasitic capacitor in a liquid crystal display panel to be released in time, an Output All-On (XAO, also called Xon sometimes) function is usually triggered on a scanning driving circuit at the moment of shutdown, which causes all the Thin Film Transistors (TFTs) in each pixel which are connected to a gate scanning line to be turned on, thereby neutralizing the discharging of respective capacitors in the pixel, which may reduce residual charges and alleviate the afterimage phenomenon during the shutdown.

However, there will be a period of time from a time when power is actually turned off to a time when a system detects that the power is turned off. At this time, a voltage drop has occurred to an operating voltage of the display, which may cause gates of the thin film transistors to be insufficiently turned on. At the same time, since a data signal line and a common electrode in the display are naturally powered off and there is no control circuit, a pixel voltage difference may occur to the liquid crystal panel during the shutdown due to inconsistency of speeds at which power of the data signal line and the common electrode is turned off, which may thereby result in flicker or afterimages appearing in a shutdown screen.

SUMMARY

According to an aspect, the embodiments of the present disclosure provide a booster circuit. The booster circuit comprises: a first input sub-circuit coupled to a first input signal terminal, a first voltage signal terminal, and an output signal terminal, and configured to transmit a first voltage signal at the first voltage signal terminal to the output signal terminal under control of a first input signal at the first input signal terminal; a second input sub-circuit coupled to a second input signal terminal, the first voltage signal terminal and a first node, and configured to transmit the first voltage signal at the first voltage signal terminal to the first node under control of a second input signal at the second input signal terminal; and a first storage sub-circuit coupled to the output signal terminal and the first node, and configured to cause a level of an output signal at the output signal terminal to be raised to a level higher than the first voltage signal.

In some embodiments, the first input sub-circuit comprises a first transistor and a first diode, wherein the first transistor has a control terminal coupled to the first input signal terminal, a first terminal coupled to a cathode of the first diode, and a second terminal coupled to the output signal terminal, and the first diode has an anode coupled to the first voltage signal terminal.

In some embodiments, the second input sub-circuit comprises: a second transistor having a control terminal coupled to the second input signal terminal, a first terminal coupled to the first voltage signal terminal, and a second terminal coupled to the first node.

In some embodiments, the first storage sub-circuit comprises: a first capacitor having one terminal coupled to the output signal terminal and the other terminal coupled to the first node.

In some embodiments, the second input sub-circuit further comprises: a second diode having an anode coupled to the first voltage signal terminal and a cathode coupled to the first terminal of the second transistor, so that the first terminal of the second transistor is indirectly coupled to the first voltage signal terminal. In some embodiments, the booster circuit further comprises: a third transistor having a control terminal coupled to the output signal terminal, a first terminal coupled to the second terminal of the second transistor, and a second terminal coupled to the first node, so that the second terminal of the second transistor is indirectly coupled to the first node. In some embodiments, the booster circuit further comprises a load sub-circuit, the load sub-circuit comprising: a second capacitor having one terminal coupled to the first node, and the other terminal grounded; and a first resistor having one terminal coupled to the first node, and the other terminal grounded.

According to another aspect, the embodiments of the present disclosure further provide a method for driving the booster circuit described above. The method comprises: during a preparation period, the first input signal terminal inputting a low level, the second input signal terminal inputting a low level, the first voltage signal terminal inputting a high level, and the output signal terminal outputting a low level; during a first period, the first input signal terminal inputting a high level, the second input signal terminal inputting a low level, the first voltage signal terminal inputting a high level, and the output signal terminal outputting a high level; and during a second period, the first input signal terminal inputting a high level, the second input signal terminal inputting a high level, the first voltage signal terminal inputting a high level, and the output signal terminal outputting a level higher than the high level which is output at the output signal terminal during the first period.

According to another aspect, the embodiments of the present disclosure further provide a shutdown circuit. The shutdown circuit comprises: a power-off detection sub-circuit coupled to a device voltage terminal, a first reference voltage terminal, a second reference voltage terminal, a second node and a third node, and configured to selectively cause a voltage at the second node to be at a high level or a low level under control of a device voltage signal at the device voltage terminal and a first reference voltage signal at the first reference voltage terminal, and configured to selectively cause a voltage at the third node to be at a high level or a low level under control of the device voltage signal at the device voltage terminal and a second reference voltage signal at the second reference voltage terminal; a booster sub-circuit coupled to the second node, the third node, the first voltage signal terminal and a fourth node, and configured to cause a voltage at the fourth node to be raised to be higher than that of the first voltage signal at the first voltage signal terminal under control of the second node and the third node; and a shutdown function sub-circuit coupled to the fourth node and configured to perform shutdown-related functions under control of the fourth node.

In some embodiments, the power-off detection sub-circuit comprises: a first comparator having a first input terminal coupled to the device voltage terminal, a second input terminal coupled to the first reference voltage terminal, and an output terminal coupled to the second node, and configured to cause a low level signal to be output from the output terminal of the first comparator in a case where a voltage of the device voltage signal at the device voltage terminal is higher than that of the first reference voltage signal at the first reference voltage terminal, so that the voltage at the second node becomes a low level, and cause a high level signal to be output from the output terminal of the first comparator in a case where the voltage of the device voltage signal at the device voltage terminal is lower than or equal to that of the first reference voltage signal at the first reference voltage terminal, so that the voltage at the second node becomes a high level; and a second comparator having a first input terminal coupled to the device voltage terminal, a second input terminal coupled to the second reference voltage terminal, and an output terminal coupled to the third node, and configured to cause a low level signal to be output from the output terminal of the second comparator in a case where the voltage of the device voltage signal at the device voltage terminal is higher than that of the second reference voltage signal at the second reference voltage terminal, so that the voltage at the third node becomes a low level, and cause a high level signal to be output from the output terminal of the second comparator in a case where the voltage of the device voltage signal at the device voltage terminal is lower than or equal to that of the second reference voltage signal at the second reference voltage terminal, so that the voltage at the third node becomes a high level.

In some embodiments, the power-off detection sub-circuit further comprises: a second resistor having one terminal coupled to the device voltage terminal, and the other terminal coupled to the respective first input terminals of the first comparator and the second comparator, so that the respective first input terminals of the first comparator and the second comparator are indirectly coupled to the device voltage terminal; and a third resistor having one terminal grounded and the other terminal coupled to the respective first input terminals of the first comparator and the second comparator.

In some embodiments, the booster sub-circuit comprises a first transistor having a control terminal coupled to the second node, a first terminal coupled to a cathode of a first diode, and a second terminal coupled to the fourth node; a second transistor having a control terminal coupled to the third node, a first terminal coupled to the first voltage signal terminal, and a second terminal coupled to the first node; the first diode having an anode coupled to the first voltage signal terminal; and a first capacitor having one terminal coupled to the fourth node and the other terminal coupled to the first node. In some embodiments, the booster sub-circuit further comprises: a second diode having an anode coupled to the first voltage signal terminal and a cathode coupled to the first terminal of the second transistor, so that the first terminal of the second transistor is indirectly coupled to the first voltage signal terminal. In some embodiments, the booster sub-circuit further comprises: a third transistor having a control terminal coupled to the fourth node, a first terminal coupled to the second terminal of the second transistor, and a second terminal coupled to the first node, so that the second terminal of the second transistor is indirectly coupled to the first node. In some embodiments, the booster sub-circuit further comprises a second capacitor having one terminal coupled to the first node, and the other terminal grounded; and a first resistor having one terminal coupled to the first node, and the other terminal grounded.

In some embodiments, the shutdown function sub-circuit comprises at least one of: a short-circuit sub-circuit configured to selectively realize a short-circuit between a data line and a common electrode of an associated display driving circuit under control of the fourth node; and a discharging sub-circuit configured to cause driving transistors in associated one or more pixel circuits to be turned on under control of the fourth node.

In some embodiments, the shutdown circuit further comprises: a shutdown function turn-on sub-circuit coupled to the second node, the fourth node, and the shutdown function sub-circuit, so that the shutdown function sub-circuit is indirectly coupled to the second node and the fourth node respectively, and configured to selectively cause a connection between the shutdown function sub-circuit and the fourth node to be turned on under control of the second node. In some embodiments, the shutdown function turn-on sub-circuit comprises a fourth transistor, a fourth resistor, and a fifth transistor, wherein the fourth transistor has a control terminal coupled to the second node, a first terminal coupled to a control terminal of the fifth transistor, and a second terminal grounded; the fourth resistor has one terminal coupled to the device voltage terminal, and the other terminal coupled to the control terminal of the fifth transistor; and the fifth transistor has a first terminal coupled to the fourth node, and a second terminal coupled to the shutdown function sub-circuit, wherein a polarity type of the fifth transistor is opposite to that of the fourth transistor.

According to another aspect, the embodiments of the present disclosure provide a method for driving the shutdown circuit described above. The method comprises: during a preparation period, the device voltage terminal inputting a device voltage signal higher than the first reference voltage signal at the first reference voltage terminal and the second reference voltage signal at the second reference voltage terminal, and the first voltage signal terminal inputting a high level, so that the shutdown function sub-circuit does not operate; during a first period, the device voltage terminal inputting a device voltage signal lower than the first reference voltage signal at the first reference voltage terminal and higher than the second reference voltage signal at the second reference voltage terminal, and the first voltage signal terminal inputting a high level, so that the shutdown function sub-circuit starts to operate; and during a second period, the device voltage terminal inputting a device voltage signal lower than the first reference voltage signal at the first reference voltage terminal and the second reference voltage signal at the second reference voltage terminal, and the first voltage signal terminal inputting a high level, so that the shutdown function sub-circuit continue to operate.

According to another aspect, the embodiments of the present disclosure provide a display apparatus. The display apparatus comprises the shutdown circuit described above.

BRIEF DESCRIPTION OF THE ACCOMPANYING DRAWINGS

The above and other purposes, features, and advantages of the present disclosure will be made clearer by describing the preferred embodiments of the present disclosure in conjunction with accompanying drawings below. In the accompanying drawings.

DETAILED DESCRIPTION

Figure 1:
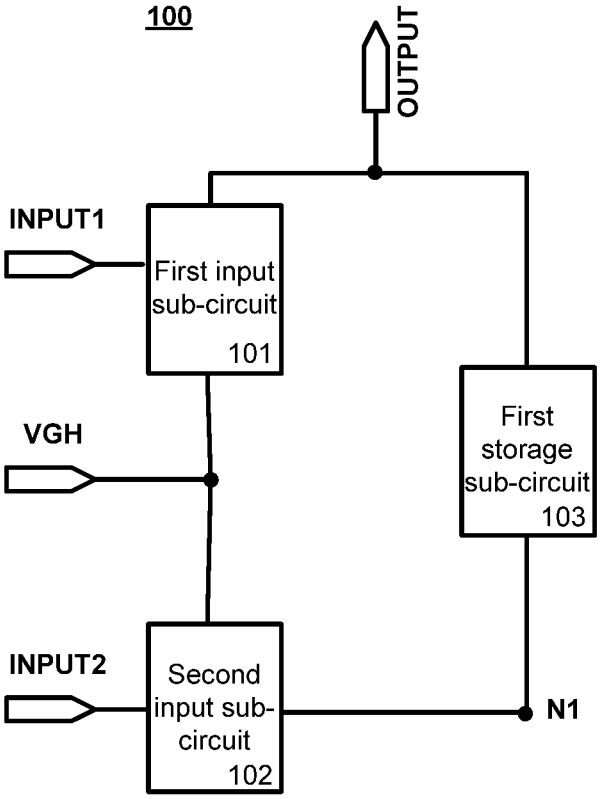
FIG. 1 is a schematic diagram illustrating an exemplary configuration of a booster circuit according to an embodiment of the present disclosure.

A part of the embodiments of the present disclosure will be described in detail below with reference to the accompanying drawings, in which details and functions which are not necessary for the present disclosure are omitted in the description in order to prevent confusion in the understanding of the present disclosure. In the present specification, the following description of various embodiments for describing the principles of the present disclosure is illustrative only and should not be construed as limiting the scope of the disclosure in any way. The following description of the drawings, with reference to the accompanying drawings, is provided to assist in a comprehensive understanding of the example embodiments of the disclosure as defined by the claims and their equivalents. The following description includes many specific details to assist in the understanding, but such details are to be regarded as merely exemplary. Accordingly, those of ordinary skill in the art will recognize that numerous changes and modifications can be made to the embodiments described herein without departing from the scope and spirit of the present disclosure. In addition, descriptions of well-known functions and structures are omitted for clarity and conciseness. In addition, the same reference numerals are used for the same or similar functions, devices and/or operations throughout the accompanying drawings. Further, in the accompanying drawings, various parts are not necessarily drawn to scale. In other words, relative sizes, lengths etc. of the various parts in the accompanying drawings do not necessarily correspond to actual ratios.

In the present disclosure, terms "include" and "contain" and their derivatives are intended to be inclusive and not restrictive, and the term "or" is inclusive, meaning and/or. In addition, in the following description of the present disclosure, oriental terms which are used such as "up," "down," "left," "right," etc. are used to indicate relative positional relationships to assist those skilled in the art in understanding the embodiments of the present disclosure. Therefore, those skilled in the art should understand that "up"/"down" in one direction may be changed to "down"/"up" in an opposite direction and may be changed to another positional relationship in another direction, such as "left"/"right" etc.

Hereinafter, the embodiments of the present disclosure will be described in detail by example of being applied to a shutdown circuit and/or a booster circuit of a display apparatus. However, it should be understood by those skilled in the art that the application field of the present disclosure is not limited thereto. In fact, the shutdown circuit and/or the boost circuit etc. according to the embodiments of the present disclosure may be applied to any other device in which a boosting function is required during shutdown.

In addition, although description is made hereinafter by taking transistors being mainly N-type transistors (except for P-type transistors which are described separately) as an example, the present disclosure is not limited thereto. In fact, it may be understood by those skilled in the art that when one or more of the transistors mentioned below are P-type transistors (or N-type transistors which are described separately), the technical solutions according to the present application may also be implemented, as long as a level setting/coupling relationship is adjusted accordingly.

In addition, the term "control terminal of a transistor" is generally used herein to denote a base of a bipolar transistor or a gate of a field effect transistor. In addition, the term "first terminal of a transistor" is generally used herein to denote an emitter of a bipolar transistor or a source of a field effect transistor, and the term "second terminal of a transistor" is generally used herein to denote a collector of a bipolar transistor or a drain of a field effect transistor, and vice versa.

As described above, since a device operating voltage of a display device rapidly drops during shutdown, which may cause a flicker or afterimage phenomenon, some embodiments of the present disclosure provide a booster circuit which may provide a voltage higher than the device operating voltage during the drop of the device operating voltage, so that functional circuits related to the shutdown (or other operations which cause the voltage drop) may operate normally. With the booster circuit, the shutdown circuit, the methods for driving the same, and the display apparatus according to the embodiments of the present disclosure, the residual charges and the afterimages during the shutdown of the display may be eliminated, which may effectively reduce the residual charges and eliminate the afterimages during the shutdown, and improve the utilization of the internal functions of the display.

Hereinafter, this booster circuit will be firstly described in detail with reference to FIGS. 1 to 5. In addition, an exemplary shutdown circuit which may adopt such a booster circuit according to an embodiment of the present disclosure will be described in detail with reference to FIGS. 6A to 10.

FIG. 1 is a schematic diagram illustrating an exemplary configuration of a booster circuit according to an embodiment of the present disclosure. As shown in FIG. 1, the booster circuit 100 may comprise a first input sub-circuit 101, a second input sub-circuit 102 and a first storage sub-circuit 103.

The first input sub-circuit 101 is coupled to a first input signal terminal INPUT1, a first voltage signal terminal VGH and an output signal terminal OUTPUT, and is configured to transmit a first voltage signal at the first voltage signal terminal VGH to the output signal terminal OUTPUT under control of a first input signal at the first input signal terminal INPUT1.

The second input sub-circuit 102 is coupled to a second input signal terminal INPUT2, the first voltage signal terminal VGH and a first node N1, and is configured to transmit the first voltage signal at the first voltage signal terminal VGH to the first node N1 under control of a second input signal at the second input signal terminal INPUT2.

The first storage sub-circuit 103 is coupled to the output signal terminal OUTPUT and the first node N1, and is configured to cause a level of an output signal at the output signal terminal OUTPUT to be raised to a level higher than the first voltage signal.

The booster circuit 100 causes the first input signal at the first input signal terminal INPUT1 to become a high level earlier than the second input signal at the second input signal terminal INPUT2, so that the output signal at the output signal terminal OUTPUT is raised to a level higher than the first voltage signal at the first voltage signal terminal VGH using a voltage difference across the first storage sub-circuit and the bootstrap effect of the first storage sub-circuit, thereby realizing a high voltage signal required during a shutdown phase.

Figure 2:
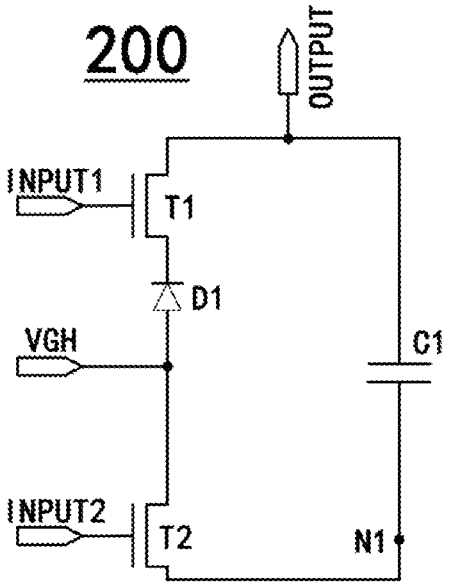
FIG. 2 is a schematic diagram illustrating an exemplary specific configuration of a booster circuit according to an embodiment of the present disclosure.

FIG. 2 is a schematic diagram illustrating an exemplary specific configuration of a booster circuit 200 according to an embodiment of the present disclosure. As shown in FIG. 2, the booster circuit 200 may comprise a first transistor T1, a second transistor T2, a first diode D1, and a first capacitor C1.

In some embodiments, the first transistor T1 may have a control terminal coupled to the first input signal terminal INPUT1, a first terminal coupled to a cathode of the first diode D1, and a second terminal coupled to the output signal terminal OUTPUT. In some embodiments, the second transistor T2 may have a control terminal coupled to the second input signal terminal INPUT2, a first terminal coupled to the first voltage signal terminal VGH, and a second terminal coupled to the first node N1. In some embodiments, the first diode D1 may have an anode coupled to the first voltage signal terminal VGH. In some embodiments, the first capacitor C1 may have one terminal coupled to the output signal terminal OUTPUT, and the other terminal coupled to the first node N1.

In general, an operating principle of the booster circuit 200 is that the booster circuit 200 causes the first input signal at the first input signal terminal INPUT1 to become a high level earlier than the second input signal at the second input signal terminal INPUT2, so that the output signal at the output signal terminal OUTPUT is raised to a level higher than the first voltage signal at the first voltage signal terminal VGH using a voltage difference across the first capacitor C1 and the bootstrap effect of the first capacitor C1, thereby realizing a high voltage signal required during a shutdown phase. However, it should be illustrated that the booster circuit according to the embodiment of the present disclosure is not limited to being applied in the shutdown phase, but may be applied to any device in which a boosting function is required. Hereinafter, a specific operation timing of the booster circuit 200 will be described in detail in conjunction with FIG. 3 and with reference to FIG. 2.

Figure 3:
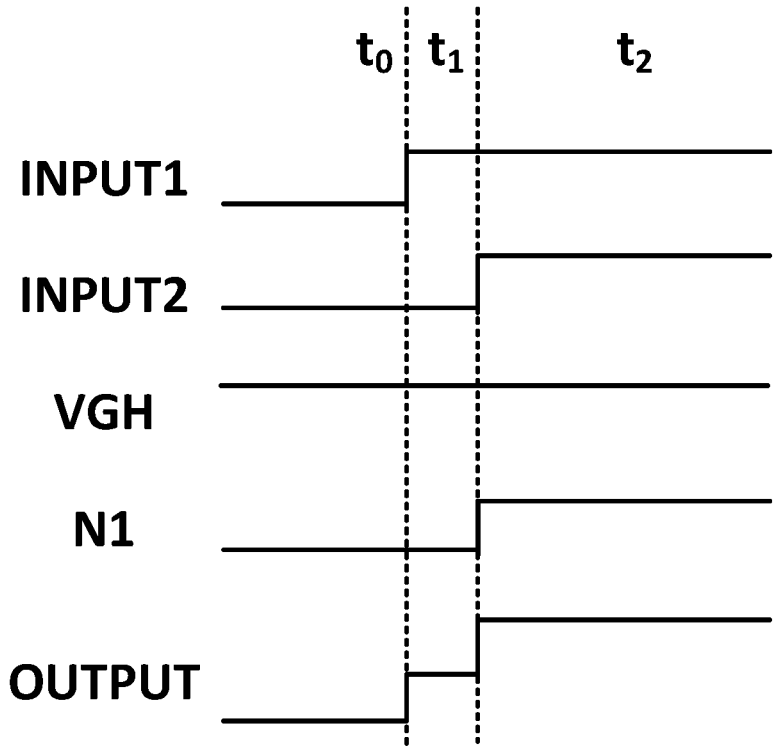
FIG. 3 is a diagram illustrating an exemplary operation timing of the booster circuit shown in FIG. 2.

FIG. 3 is a diagram illustrating an exemplary operation timing of the booster circuit 200 shown in FIG. 2. It should be illustrated that it is only used for illustrative purposes, and may not be necessarily consistent with an actual timing diagram completely. As shown in FIG. 3, the operation timing of the booster circuit 200 may be generally divided into three periods which are a preparation period to, a first period $t_1$, and a second period $t_2$.

During the preparation period $t_0$, the first input signal terminal INPUT1 may input a low level, the second input signal terminal INPUT2 may input a low level, the first voltage signal terminal VGH may input a high level, and the output signal terminal OUTPUT may output a low level.

More specifically, as shown in FIG. 2, when both of the first input signal terminal INPUT1 and the second input signal terminal INPUT2 input a low level, both of the first transistor T1 and the second transistor T2 are turned off. In a case where the booster circuit 200 is applied to a shutdown circuit, at this time, this phase corresponds to a phase in which a corresponding device operates normally or at least a phase before it is detected that shutdown of the device occurs. Since the first transistor T1 and the second transistor T2 have never be turned on after the device is powered on, and there is no other power supply in the booster circuit, various reference nodes (comprising the first node N1 and excluding each reference node coupled to the first voltage signal terminal VGH) of the circuit are at a low potential or a zero potential. Therefore, both of the output signal terminal OUTPUT and the first node N1 in the booster circuit 200 are at a low level.

During the first period $t_1$, the first input signal terminal INPUT1 may input a high level, the second input signal terminal INPUT2 may input a low level, the first voltage signal terminal VGH may input a high level, and the output signal terminal OUTPUT may output a high level.

More specifically, as shown in FIG. 2, when the first input signal terminal INPUT1 inputs a high level and the second input signal terminal INPUT2 inputs a low level, the first transistor T1 is turned on, and the second transistor T2 is turned off. In some embodiments, this period may correspond to a period in which a voltage drop of the device due to the shutdown of the device is just detected. The first transistor T1 is turned on, so that the first voltage signal having a high level at the first voltage signal terminal VGH is transmitted to the output signal terminal OUTPUT and one terminal (for example, an upper electrode of the first capacitor C1 in FIG. 2) of the first capacitor C1 through the first diode D1 and the first transistor T1. Thereby, the output signal terminal OUTPUT outputs a high level signal, and charges are accumulated on the first capacitor C1 and a voltage difference is formed across the first capacitor C1. At this time, since the second transistor T2 is turned off, the first node N1 and the other terminal of the first capacitor C1 are still maintained at a low potential or a zero potential.

During the second period $t_2$, the first input signal terminal INPUT1 may input a high level, the second input signal terminal INPUT2 may input a high level, the first voltage signal terminal VGH may input a high level, and the output signal terminal OUTPUT may output a level higher than the high level which is output at the output signal terminal OUTPUT during the first period $t_1$.

More specifically, as shown in FIG. 2, when both of the first input signal terminal INPUT1 and the second input signal terminal INPUT2 input a high level, both of the first transistor T1 and the second transistor T2 are turned on. At this time, the first voltage signal having a high level at the first voltage signal terminal VGH is transmitted to the first node N1 and the other terminal (for example, a lower electrode of the first capacitor C1 shown in FIG. 2) of the first capacitor C1 through the second transistor T2. Since there is a voltage difference across the first capacitor C1 before, in a case where the other terminal of the first capacitor C1 suddenly changes from a low potential to a high potential, a potential at one terminal of the first capacitor C1 which is coupled to the output signal terminal OUTPUT may be raised due to the bootstrap effect of the first capacitor C1, and thereby a voltage signal having a voltage higher than that of the first voltage signal is formed, as shown by a waveform at the output signal terminal OUTPUT during the second period $t_2$ in FIG. 3. In addition, due to the presence of the first diode D1 which may be turned on unidirectionally, the higher potential may not affect the first node N1 and the other terminal of the first capacitor C1.

Therefore, a voltage difference is firstly formed across the first capacitor C1 and then the voltage at the output signal terminal OUTPUT is raised using the bootstrap effect of the first capacitor C1, so that the high level signal required during the shutdown phase may be realized. However, it should be illustrated that the design of the booster circuit is not limited to the embodiment shown in FIG. 2. For example, another embodiment of the booster circuit will be described next in detail in conjunction with FIG. 4.

Figure 4:
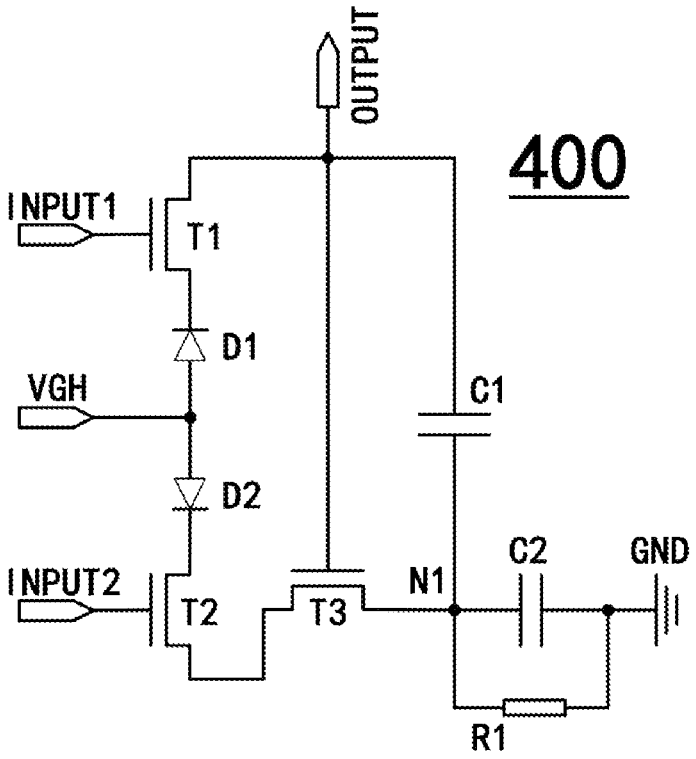
FIG. 4 is a schematic diagram illustrating an exemplary specific configuration of a booster circuit according to another embodiment of the present disclosure.

FIG. 4 is a schematic diagram illustrating an exemplary specific configuration of a booster circuit 400 according to another embodiment of the present disclosure. For conciseness and clarity of the description, only the differences between the booster circuit 400 shown in FIG. 4 and the booster circuit 200 shown in FIG. 2 will be described herein. As shown in FIG. 4, in addition to the first transistor T1, the second transistor T2, the first diode D1, and the first capacitor C1, in an embodiment, the booster circuit 400 further comprises a second diode D2, a third transistor T3, a second capacitor C2 and/or a first resistor R1.

In some embodiments, the second diode D2 may have an anode coupled to the first voltage signal terminal VGH, and a cathode coupled to the first terminal of the second transistor T2, so that the first terminal of the second transistor T2 is indirectly coupled to the first voltage signal terminal VGH instead of being directly coupled thereto as shown in FIG. 2. In this way, the first diode D1 and the second diode D2 control a direction of current respectively, so that the current may only be used for charging in a direction where a voltage is raised, thereby completing a bootstrapping action of the first capacitor C1. However, it should be illustrated that the second diode D2 is not necessary, and is an optional circuit element.

In some embodiments, the third transistor T3 may have a control terminal coupled to the output signal terminal OUTPUT, a first terminal coupled to the second terminal of the second transistor T2, and a second terminal coupled to the first node N1, so that the second terminal of the second transistor T2 is indirectly coupled to the first node N1 instead of being directly coupled thereto as shown in FIG. 2. As shown in FIG. 4, the third transistor T3 may complete the bootstrap using gate-source capacitance of its own. However, it should be illustrated that the bootstrap effect may not be sufficient to cause the level of the output signal at the output signal terminal OUTPUT to be fully raised. Therefore, in the embodiment shown in FIG. 4, the first capacitor C1 is still required, but the present disclosure is not limited thereto.

In some embodiments, the second capacitor C2 may have one terminal coupled to the first node N1, and the other terminal grounded. In some embodiments, the first resistor R1 may have one terminal coupled to the first node N1, and the other terminal grounded. Thus, the second capacitor C2 and the first resistor R1 are connected in parallel between the first node N1 and the ground, and constitute an RC load sub-circuit as a load in the circuit. However, it should be illustrated that the second capacitor C2 and the first resistor R1 here are generally only equivalent circuit elements used to represent the load, and therefore, in some embodiments, both of the second capacitor C2 and the first resistor R1 may be omitted from a circuit design.

Similarly to the embodiment shown in FIG. 2, an operation timing of the booster circuit 400 shown in FIG. 4 may also be explained using FIG. 3. For example, during a preparation period to, since the first node N1 is grounded through the RC load sub-circuit, the first node N1 is substantially at a zero potential, which further ensures that one terminal of the first capacitor C1 on the side of the first node N1 is at a relatively low potential during subsequent phases. During a first period $t_1$, since the output signal terminal OUTPUT is at a high potential (as described in conjunction with FIGS. 2 and 3), the third transistor T3 is turned on, so that a connection between the second terminal of the second transistor T2 and the first node N1 is in a turn-on state during the current period $t_1$ and a subsequent period $t_2$, and thus the principle during these periods is the same as that in the embodiment shown in FIG. 2. In other words, the booster circuit 400 may realize the boosting function more stably.

A method for driving a booster circuit according to an embodiment of the present disclosure will be described in detail below with reference to FIG. 5.

Figure 5:
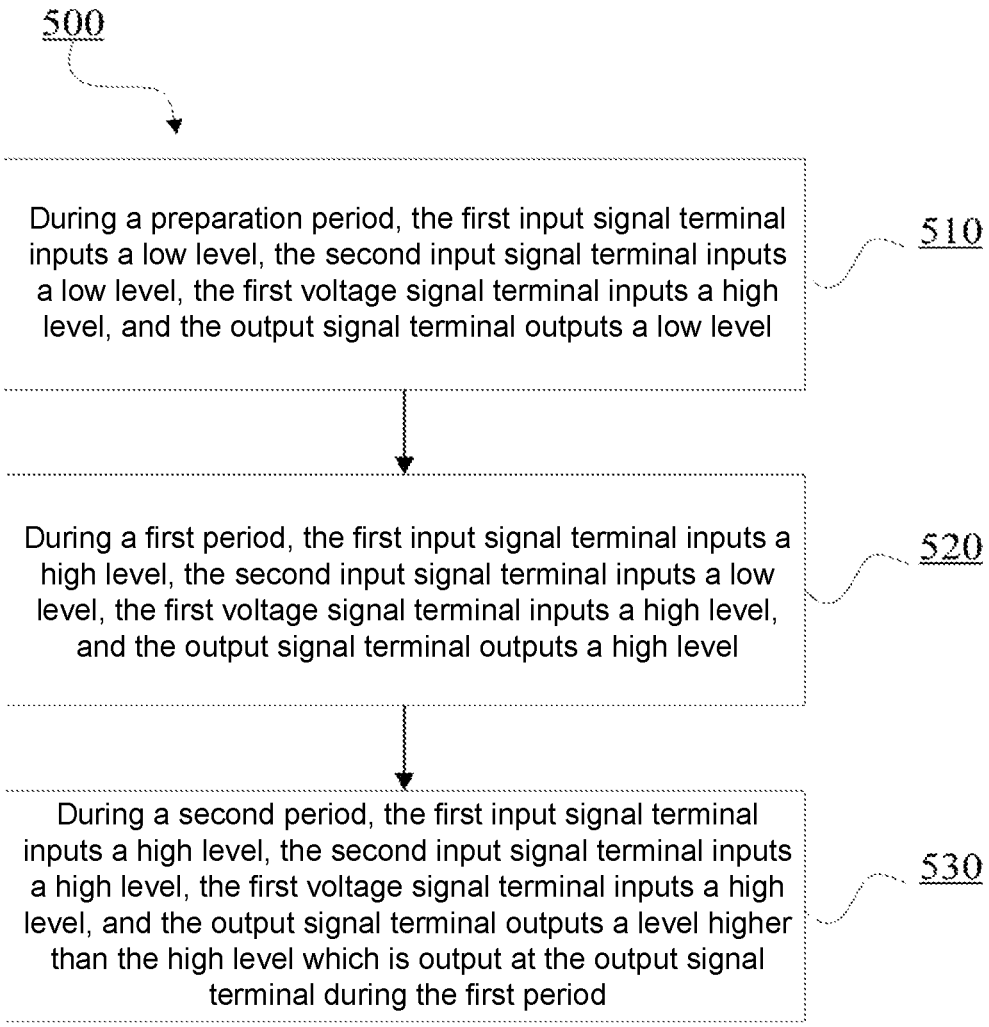
FIG. 5 is a flowchart illustrating an exemplary method for driving a booster circuit according to an embodiment of the present disclosure.

FIG. 5 is a flowchart illustrating an exemplary method for driving the booster circuit 200 and/or 400 according to an embodiment of the present disclosure. As shown in FIG. 5, the method 500 may comprise steps S510, S520, and S530. According to the present disclosure, some steps of the method 500 may be performed individually or in combination, and may be performed in parallel or sequentially, and are not limited to a specific operation order shown in FIG. 5. In some embodiments, the method 500 may be performed by each booster circuit described herein or another external device.

The method 500 may start at step S510. In step S510, during a preparation period to, the first input signal terminal INPUT1 may input a low level, the second input signal terminal INPUT2 may input a low level, the first voltage signal terminal VGH may input a high level, and the output signal terminal OUTPUT may output a low level.

In step S520, during a first period $t_1$, the first input signal terminal INPUT1 may input a high level, the second input signal terminal INPUT2 may input a low level, the first voltage signal terminal VGH may input a high level, and the output signal terminal OUTPUT may output a high level.

In step S530, during a second period $t_2$, the first input signal terminal INPUT1 may input a high level, the second input signal terminal INPUT2 may input a high level, the first voltage signal terminal VGH may input a high level, and the output signal terminal OUTPUT may output a level higher than the high level which is output at the output signal terminal OUTPUT during the first period $t_1$.

Therefore, with the booster circuit and the method for driving the same according to the embodiment of the present disclosure, the voltage at the output signal terminal OUTPUT may be raised under the bootstrap effect of the first capacitor C1, and thus a desired boosting signal may be output. However, it should be illustrated that the design of the booster circuit is not limited to the embodiment shown in FIG. 2 and/or FIG. 4.

Next, an exemplary shutdown circuit which may adopt such a booster circuit according to an embodiment of the present disclosure will be described in detail with reference to FIGS. 6A to 10.

Figure 6A:
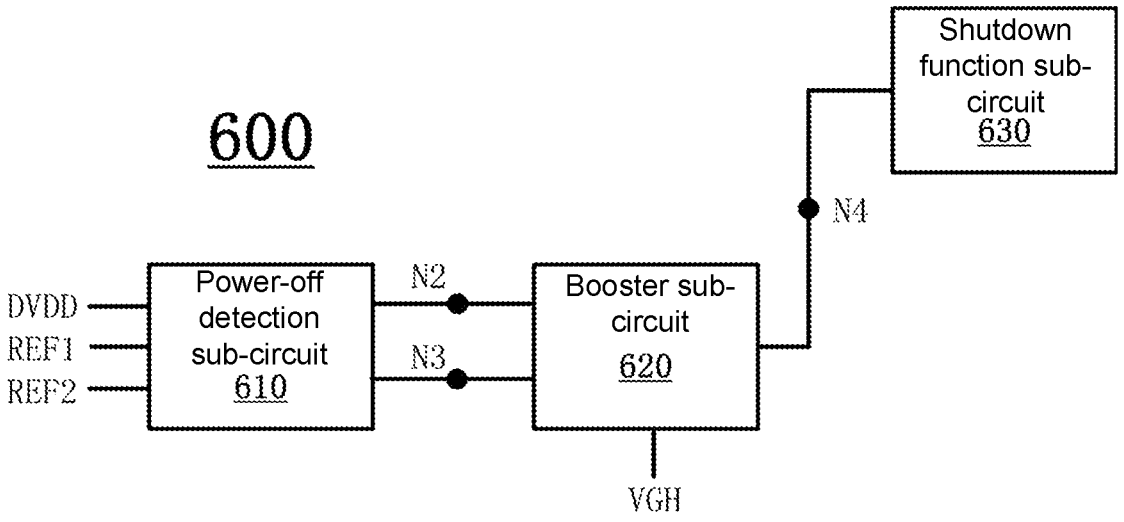
FIG. 6A is a schematic diagram illustrating an exemplary sub-circuit of a shutdown circuit according to an embodiment of the present disclosure.
Figure 6B:
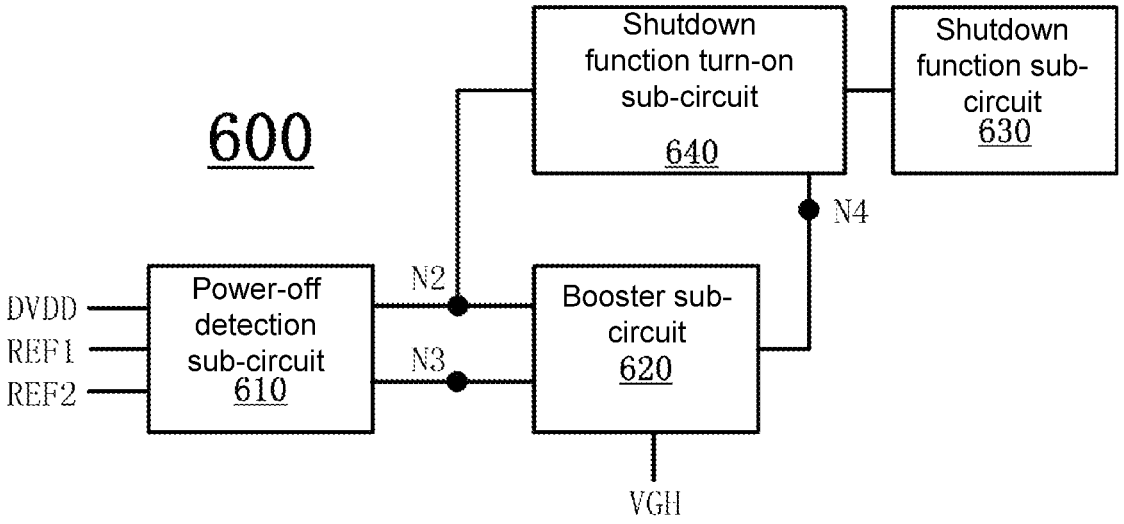
FIG. 6B is a schematic diagram illustrating an exemplary sub-circuit of a shutdown circuit according to another embodiment of the present disclosure.

FIGS. 6A and 6B are schematic diagrams respectively illustrating exemplary sub-circuits of the shutdown circuit 600 according to an embodiment of the present disclosure. As shown in FIG. 6A, the shutdown circuit 600 may comprise a power-off detection sub-circuit 610, a booster sub-circuit 620, and a shutdown function sub-circuit 630. In addition, in some embodiments, the shutdown circuit 600 may further comprise an optional shutdown function turn-on sub-circuit 640, as shown in FIG. 6B.

In some embodiments, the power-off detection sub-circuit 610 may be coupled to a device voltage terminal DVDD, a first reference voltage terminal REF1, a second reference voltage terminal REF2, a second node N2 and a third node N3, and may be configured to selectively cause a voltage at the second node N2 to be at a high level or a low level under control of a device voltage signal at the device voltage terminal DVDD and a first reference voltage signal at the first reference voltage terminal REF1, and may be configured to selectively cause a voltage at the third node N3 to be at a high level or a low level under control of the device voltage signal at the device voltage terminal DVDD and a second reference voltage signal at the second reference voltage terminal REF2.

In some embodiments, the booster sub-circuit 620 may be coupled to the second node N2, the third node N3, the first voltage signal terminal VGH, and a fourth node N4, and may be configured to cause a voltage at the fourth node N4 to be raised to be higher than that of a first voltage signal at a first voltage signal terminal VGH under control of the second node N2 and the third node N3. In some embodiments, the booster sub-circuit 620 may be, for example, the shutdown circuit 200 shown in FIG. 2 or the shutdown circuit 400 shown in FIG. 4.

In some embodiments, the shutdown function sub-circuit 630 may be coupled to the fourth node N4 and may be configured to perform shutdown-related functions under control of the fourth node N4.

In some embodiments, as shown in FIG. 6B, the optional shutdown function turn-on sub-circuit 640 may be coupled to the second node N2, the fourth node N4, and the shutdown function sub-circuit 630, so that the shutdown function sub-circuit 630 may be indirectly coupled to the second node N2 and the fourth node N4, and may be configured to selectively cause a connection between the shutdown function sub-circuit 630 and the fourth node N4 to be turned on under control of the second node N2.

It should be illustrated that, as shown in FIG. 6B, a part of coupling between the shutdown function sub-circuit 630 and the fourth node N4 in the optional shutdown function turn-on sub-circuit 640 should be represented by dotted lines, which may indicate that if the shutdown function turn-on sub-circuit 640 does not exist, the coupling is direct coupling (which is, for example, similar to FIG. 6A), and if the shutdown function turn-on sub-circuit 640 exists, the coupling is indirect coupling through the shutdown function turn-on sub-circuit 640.

Next, a specific configuration of the shutdown circuit 600 shown in FIG. 6A will be described in detail with reference to FIG. 7.

Figure 7:
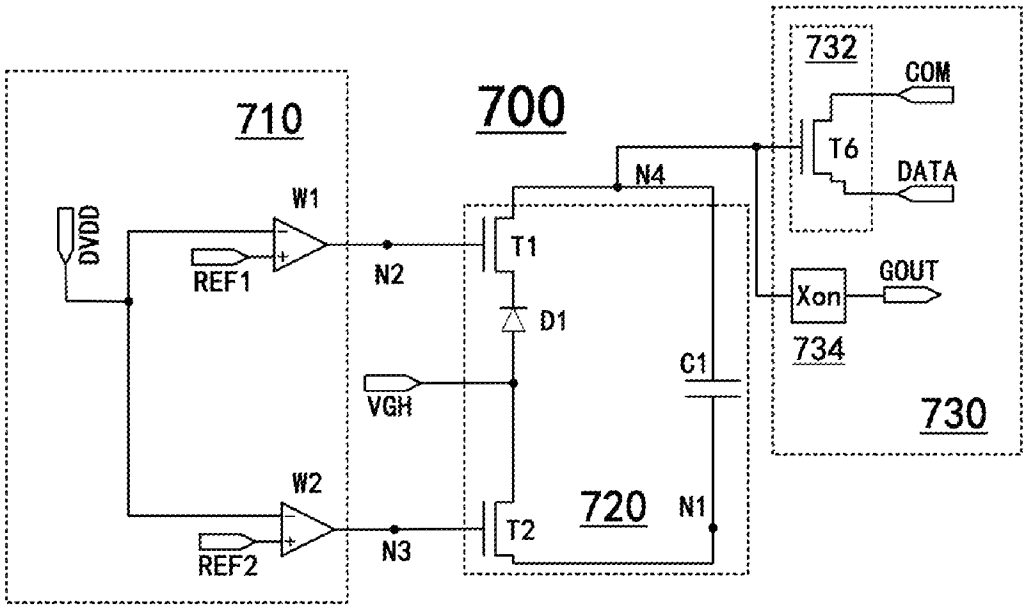
FIG. 7 is a schematic diagram illustrating an exemplary specific configuration of the shutdown circuit shown in FIG. 6A.

FIG. 7 is a schematic diagram illustrating an exemplary specific configuration 700 of the shutdown circuit 600 shown in FIG. 6A. As shown in FIG. 7, the shutdown circuit 700 may comprise a power-off detection sub-circuit 710, a booster sub-circuit 720, and a shutdown function sub-circuit 730, which may correspond to the power-off detection sub-circuit 610, the booster sub-circuit 620, and the shutdown function sub-circuit 630 shown in FIG. 6A respectively. In addition, as shown in FIG. 6A, the booster sub-circuit 720 has substantially the same configuration as that of the booster circuit 200 shown in FIG. 2.

Returning to FIG. 7, in some embodiments, the power-off detection sub-circuit 710 may comprise a first comparator W1 having a first input terminal coupled to the device voltage terminal DVDD, a second input terminal coupled to the first reference voltage terminal REF1, and an output terminal coupled to the second node N2, and may be configured to cause a low level signal to be output from the output terminal of the first comparator W1 in a case where a voltage of the device voltage signal at the device voltage terminal DVDD is higher than that of the first reference voltage signal at the first reference voltage terminal REF1, so that the voltage at the second node N2 becomes a low level, and cause a high level signal to be output from the output terminal of the first comparator W1 in a case where the voltage of the device voltage signal at the device voltage terminal DVDD is lower than or equal to that of the first reference voltage signal at the first reference voltage terminal REF1, so that the voltage at the second node N2 becomes a high level. In addition, the power-off detection sub-circuit 710 may further comprise a second comparator W2 having a first input terminal also coupled to the device voltage terminal DVDD, a second input terminal coupled to the second reference voltage terminal REF2, and an output terminal coupled to the third node N3, and may be configured to cause a low level signal to be output from the output terminal of the second comparator W2 in a case where the voltage of the device voltage signal at the device voltage terminal DVDD is higher than that of the second reference voltage signal at the second reference voltage terminal REF2, so that the voltage at the third node N3 becomes a low level, and cause a high level signal to be output from the output terminal of the second comparator W2 in a case where the voltage of the device voltage signal at the device voltage terminal DVDD is lower than or equal to that of the second reference voltage signal at the second reference voltage terminal REF2, so that the voltage at the third node N3 becomes a high level.

In addition, in some embodiments, the first reference voltage signal at the first reference voltage terminal REF1 may be higher than the second reference voltage signal at the second reference voltage terminal REF2, so that in a case where the device voltage at the device voltage terminal DVDD continues to decrease (during, for example, a shutdown phase), the second node N2 may become a high level earlier than the third node N3, thereby satisfying the requirements of two input signals by an operation timing of the booster sub-circuit 720 (see, for example, the above description in conjunction with FIGS. 2 and 3).

The function of the power-off detection sub-circuit 710 may be realized by using the first comparator W1 and second comparator W2, that is, the power-off detection sub-circuit 710 is coupled to the device voltage terminal DVDD, the first reference voltage terminal REF1, the second reference voltage terminal REF2, the second node N2, and the third node N3, and is configured to selectively cause the voltage at the second node N2 to be at a high level or a low level under control of the device voltage signal at the device voltage terminal DVDD and the first reference voltage signal at the first reference voltage terminal REF1, and is configured to selectively cause the voltage at the third node N3 to be at a high level or a low level under control of the device voltage signal at the device voltage terminal DVDD and the second reference voltage signal at the second reference voltage terminal REF2.

In addition, in some embodiments, the booster sub-circuit 720 may comprise a first transistor T1, a second transistor T2, a first diode D1, and a first capacitor C1. The first transistor T1 may have a control terminal coupled to the second node N2, a first terminal coupled to a cathode of the first diode D1, and a second terminal coupled to the fourth node N4. The second transistor T2 may have a control terminal coupled to the third node N3, a first terminal coupled to the first voltage signal terminal VGH, and a second terminal coupled to the first node N1. The first diode D1 may have an anode coupled to the first voltage signal terminal VGH. The first capacitor C1 may have one terminal coupled to the fourth node N4, and the other terminal coupled to the first node N1.

By comparing the booster circuit 200 of FIG. 2 with the booster sub-circuit 720 of FIG. 7, it may be found that the two booster circuits have substantially the same configuration, and the second node N2 shown in FIG. 7 may correspond to the first input signal terminal INPUT1 shown in FIG. 2, the third node N3 shown in FIG. 7 may correspond to the second input signal terminal INPUT2 shown in FIG. 2, and the fourth node N4 shown in FIG. 7 may correspond to the output signal terminal OUTPUT shown in FIG. 2. Therefore, for conciseness and clarity of the description, these nodes will not be described in detail here.

The function of the booster sub-circuit 720 may be realized by using the above elements, that is, the booster sub-circuit 720 is coupled to the second node N2, the third node N3, the first voltage signal terminal VGH, and the fourth node N4, and is configured to cause the voltage at the fourth node N4 to be raised to be higher than that of the first voltage signal at the first voltage signal terminal VGH under control of the second node N2 and the third node N3.

In addition, in some embodiments, the shutdown function sub-circuit 730 may comprise at least one of a short-circuit sub-circuit 732, a discharging sub-circuit Xon 734, or other shutdown function sub-circuits. As shown in FIG. 7, the short-circuit sub-circuit 732 may be configured to realize a short-circuit between a data line DATA and a common electrode COM of an associated display driving circuit, so as to avoid a problem of afterimages appearing on a display screen due to a difference in discharging speed therebetween and a voltage difference therebetween during a shutdown phase. More specifically, the short-circuit sub-circuit 732 may comprise a sixth transistor T6 having a control terminal coupled to the fourth node N4, a first terminal coupled to the common electrode COM, and a second terminal coupled to the data line DATA. Therefore, when the fourth node N4 is at a high level (or a higher level), the sixth transistor T6 is turned on, and thereby the short-circuit is realized between the data line DATA and the common electrode COM to eliminate the voltage difference therebetween, so as to avoid flicker or afterimage phenomenon.

In addition, the discharging sub-circuit Xon 734 may be configured to directly or indirectly couple the fourth node N4 with an associated gate scanning line Gout, so that when the fourth node N4 is at a high level (or a higher level), corresponding transistors in pixel circuits associated with the corresponding gate scanning line Gout are fully turned on to fully discharge all the capacitors in pixels to avoid the flicker or afterimage phenomenon appearing on the display screen.

The function of the shutdown function sub-circuit 730 may be realized by using the above elements, that is, the shutdown function sub-circuit 730 is coupled to the fourth node, and is configured to perform shutdown-related functions under control of the fourth node. Hereinafter, a specific operation timing of the shutdown circuit 700 will be described in detail in conjunction with FIG. 8 and with reference to FIG. 7.

Figure 8:
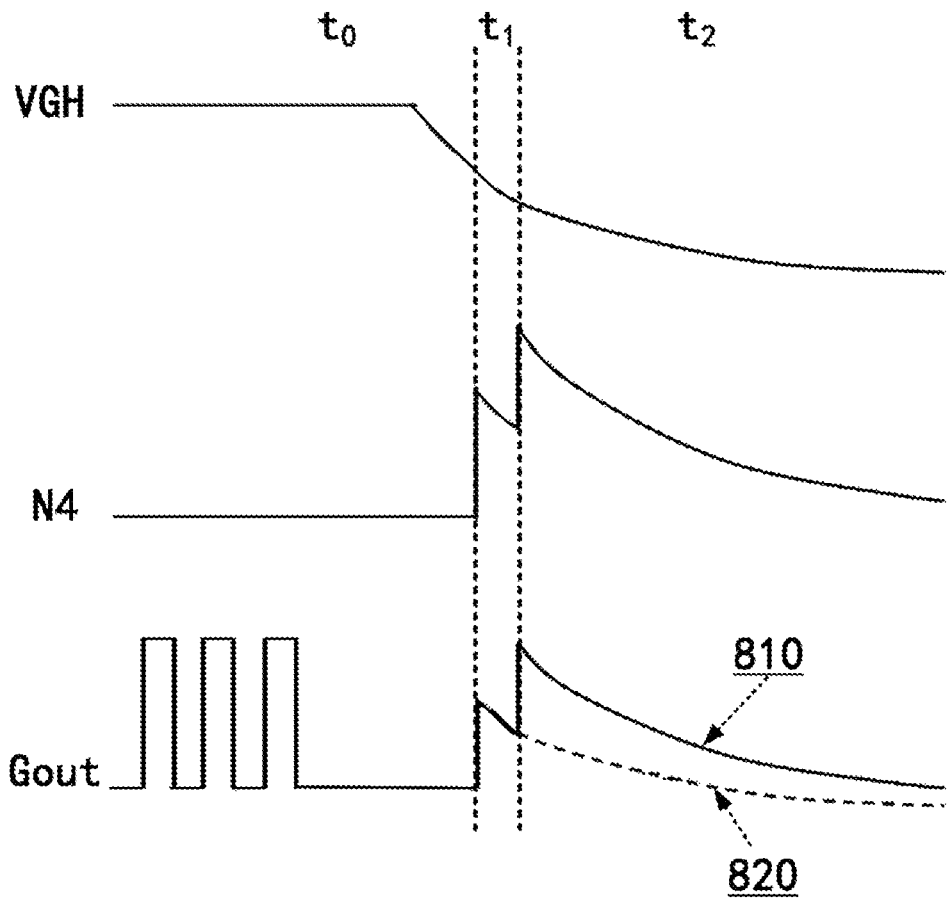
FIG. 8 is a diagram illustrating an exemplary operation timing of the shutdown circuit shown in FIG. 7.

FIG. 8 is a diagram illustrating an exemplary operation timing of the shutdown circuit 700 shown in FIG. 7. It should be illustrated that it is only used to illustrate specific embodiments of the present disclosure, and therefore the present disclosure is not limited thereto. In other words, in some other embodiments, even if the same shutdown circuit 700 is used, different operation timings may occur. As shown in FIG. 8, an operation timing of the shutdown circuit 700 may be generally divided into three periods which are a preparation period to, a first period $t_1$, and a second period $t_2$.

Figure 9:
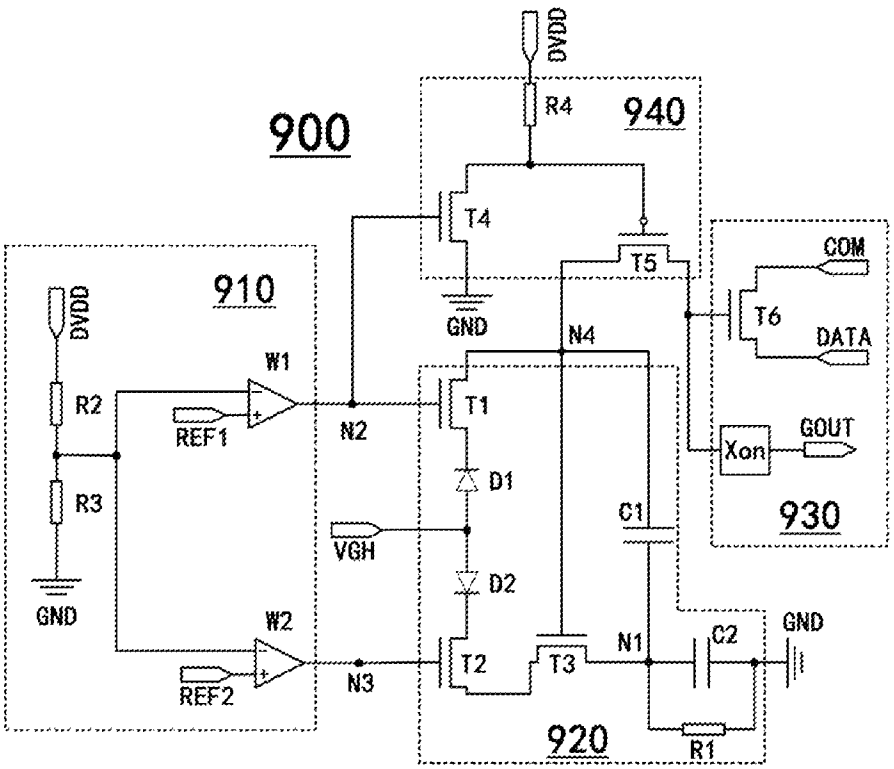
FIG. 9 is a schematic diagram illustrating an exemplary specific configuration of the shutdown circuit shown in FIG. 6B.

During the preparation period to, the device voltage terminal DVDD may input a device voltage signal higher than the first reference voltage signal at the first reference voltage terminal REF1 and the second reference voltage signal at the second reference voltage terminal REF2, and the first voltage signal terminal VGH may input a high level, so that the shutdown function sub-circuit does not operate (which may, in an embodiment, be indirectly controlled by the shutdown function turn-on sub-circuit 940, as described below in conjunction with FIG. 9).

Specifically, referring to both of FIG. 7 and FIG. 8, when the device operates normally, the device voltage signal at the device voltage terminal DVDD is at a high level, which may, at this time, be higher than the first reference voltage signal at the first reference voltage terminal REF1 and the second reference voltage signal at the second reference voltage terminal REF2, so that both of the first comparator W1 and the second comparator W2 output a low level signal. Thereby, a situation of the booster sub-circuit 720 is the same as that of the booster circuit 200 shown in FIG. 2 during the preparation period to shown in FIG. 3, so that the fourth node N4 is at a low level, and finally the shutdown function sub-circuit 730 does not operate.

Then, as the device is shut down, a voltage of the device voltage signal at the device voltage terminal DVDD (and the first voltage signal terminal VGH) thereof starts to decrease, as shown in a latter portion of the preparation period to shown in FIG. 8; however, as long as the voltage of the device voltage signal at the device voltage terminal DVDD remains higher than the first reference electrical signal and the second reference voltage signal, the procedure may not enter the next period $t_1$. However, once the voltage of the device voltage signal at the device voltage terminal DVDD is less than or equal to the first reference voltage signal, the procedure enters the next period $t_1$.

During the first period $t_1$, the device voltage terminal DVDD (and the first voltage signal terminal VGH) may input a device voltage signal lower than the first reference voltage signal at the first reference voltage terminal REF1 and higher than the second reference voltage signal at the second reference voltage terminal REF2, and the first voltage signal terminal VGH may input a high level, so that the shutdown function sub-circuit 730 may start to operate (which may, in an embodiment, be indirectly controlled by the shutdown function turn-on sub-circuit 940, as described below in conjunction with FIG. 9).

Specifically, referring to both of FIG. 7 and FIG. 8, when it is detected by the shutdown circuit 700 that shutdown occurs, that is, when it is detected by the first comparator W1 that the device voltage signal at the device voltage terminal DVDD is lower than the first reference voltage signal at the first reference voltage terminal REF1 and higher than the second reference voltage signal at the second reference voltage terminal REF2, the first comparator W1 outputs a high level signal, and the second comparator W2 outputs a low level signal. Thereby, the situation of the booster sub-circuit 720 is the same as that of the booster circuit 200 shown in FIG. 2 during the first period $t_1$ shown in FIG. 3, so that the fourth node N4 is at a high level, and finally the shutdown function sub-circuit 730 starts to operate. As the voltages of the device voltage signal and the first voltage signal continue to decrease, the procedure enters the next period $t_2$.

During the second period $t_2$, the device voltage terminal DVDD may input a device voltage signal lower than the first reference voltage signal at the first reference voltage terminal REF1 and the second reference voltage signal at the second reference voltage terminal REF2, and the first voltage signal terminal VGH may input a high level, so that the shutdown function sub-circuit continues to operate (which may, in an embodiment, be indirectly controlled by the shutdown function turn-on sub-circuit 940, as described below in conjunction with FIG. 9).

Specifically, referring to both of FIG. 7 and FIG. 8, when the device voltage signal at the device voltage terminal DVDD decreases to be further lower than the second reference voltage signal at the second reference voltage terminal REF2, both of the first comparator W1 and the second comparator W2 output a high level signal. Thereby, the situation of the booster sub-circuit 720 is the same as that of the booster circuit 200 shown in FIG. 2 during the second period $t_2$ shown in FIG. 3, so that the fourth node N4 is at a higher high level, and finally the shutdown function sub-circuit 730 continues to operate.

In addition, reference signs 810 and 820 in FIG. 8 indicate signals output by the shutdown function sub-circuit 730 to the corresponding gate scanning line Gout when the shutdown circuit 700 is used and when the shutdown circuit 700 is not used respectively. It may be seen that in a case where the shutdown circuit 700 is used, the voltage is higher, so that control terminals of the corresponding transistors in the pixel circuits associated with the gate scanning line Gout are turned on more fully, thereby avoiding insufficient discharging of the pixel circuits due to the voltage which is not high enough as well as resulting problems such as afterimages, flicker etc.

However, it should be illustrated that the design of the shutdown circuit is not limited to the embodiment shown in FIG. 7. For example, another embodiment of the shutdown circuit will be described next in detail in conjunction with FIG. 9.

FIG. 9 is a schematic diagram illustrating an exemplary specific configuration 900 of the shutdown circuit 600 shown in FIG. 6B. For conciseness and clarity of the description, only the differences between the shutdown circuit 900 shown in FIG. 9 and the shutdown circuit 700 shown in FIG. 7 will be described herein.

The shutdown circuit 900 shown in FIG. 9 may comprise: a power-off detection sub-circuit 910, a booster sub-circuit 920, a shutdown function sub-circuit 930, and an optional shutdown function turn-on sub-circuit 940, which may correspond to the power-off detection sub-circuit 610, the booster sub-circuit 620, the shutdown function sub-circuit 630, and the shutdown function turn-on sub-circuit 640 shown in FIG. 6B respectively. In addition, as shown in FIG. 9, the booster sub-circuit 920 actually has substantially the same configuration as that of the booster circuit 400 shown in FIG. 4.

As shown in FIG. 9, compared with the power-off detection sub-circuit 710 shown in FIG. 7, in addition to the first comparator W1 and the second comparator W2, the power-off detection sub-circuit 910 may further comprise a second resistor R2 and a third resistor R3. In some embodiments, the second resistor R2 may have one terminal coupled to the device voltage terminal DVDD, and the other terminal coupled to the respective first input terminals of the first comparator W1 and the second comparator W2, so that the respective first input terminals of the first comparator W1 and the second comparator W2 are indirectly coupled to the device voltage terminal DVDD. In some embodiments, the third resistor R3 may have one terminal grounded, and the other terminal coupled to the respective first input terminals of the first comparator W1 and the second comparator W2. Thus, the second resistor R2 and the third resistor R3 form a voltage-division circuit between the device voltage terminal DVDD and the ground, so that the device voltage signal at the device voltage terminal DVDD may be compared with a reference voltage signal which is appropriately set (when, for example, the device voltage signal at the device voltage terminal DVDD is relatively high and thus may not be directly compared). In addition, in some embodiments, the second resistor R2 may also be omitted separately.

As shown in FIG. 9, compared with the booster sub-circuit 720 shown in FIG. 7, in addition to the first transistor T1, the second transistor T2, the first diode D1, and the first capacitor C1, the booster sub-circuit 920 may further comprise a second diode D2, a third transistor T3, a second capacitor C2, and/or a first resistor R1.

In some embodiments, the second diode D2 may have an anode coupled to the first voltage signal terminal VGH, and a cathode coupled to a first terminal of the second transistor T2, so that the first terminal of the second transistor T2 is indirectly coupled to the first voltage signal terminal VGH instead of being directly coupled thereto as shown in FIG. 7. In this way, the first diode D1 and the second diode D2 control a direction of current respectively, so that the current may only be used for charging in a direction where a voltage is raised, thereby completing a bootstrapping action of the first capacitor C1.

In some embodiments, the third transistor T3 may have a control terminal coupled to the fourth node N4, a first terminal coupled to the second terminal of the second transistor T2, and a second terminal coupled to the first node N1, so that the second terminal of the second transistor T2 is indirectly coupled to the first node N1 instead of being directly coupled thereto as shown in FIG. 7. As shown in FIG. 9, the third transistor T3 may complete the bootstrap using gate-source capacitance of its own.

In some embodiments, the second capacitor C2 may have one terminal coupled to the first node N1, and the other terminal grounded. In some embodiments, the first resistor R1 may have one terminal coupled to the first node N1, and the other terminal grounded. Thus, the second capacitor C2 and the first resistor R1 are connected in parallel between the first node N1 and the ground, and constitute an RC load sub-circuit as a load in the circuit.

Similarly to the embodiment shown in FIG. 7, an operation timing of the shutdown circuit 900 shown in FIG. 9 may also be explained using FIG. 8. For example, during a preparation period to, since the first node N1 is grounded through the RC load sub-circuit, the first node N1 is substantially at a zero potential, which ensures that one terminal of the first capacitor C1 on the side of the first node N1 is at a relatively low potential in subsequent periods. During a first period $t_1$, since the fourth node N4 is at a high potential (as described in conjunction with FIGS. 7 and 8), the third transistor T3 is turned on, so that a connection between the second terminal of the second transistor T2 and the first node N1 is in a turn-on state during the current period $t_1$ and a subsequent period $t_2$, and thus the principle during the these periods is the same as that in the embodiment shown in FIG. 7.

As shown in FIG. 9, the shutdown function sub-circuit 930 is similar to the shutdown function sub-circuit 730 shown in FIG. 7, and therefore a detailed description thereof is omitted here.

In addition, the shutdown circuit 900 shown in FIG. 9 further comprises a shutdown function turn-on sub-circuit 940 not included in FIG. 7. As shown in FIG. 9, the shutdown function turn-on sub-circuit 940 may comprise a fourth transistor T4 having a control terminal coupled to the second node N2, a first terminal coupled to a control terminal of the fifth transistor T5, and a second terminal grounded; the optional fourth resistor R4 having one terminal coupled to the device voltage terminal DVDD, and the other terminal coupled to the control terminal of the fifth transistor T5; and the fifth transistor T5 having a first terminal coupled to the fourth node N4, and a second terminal coupled to the shutdown function sub-circuit 930, wherein a polarity type of the fifth transistor T5 may be opposite to that of the fourth transistor T4.

In this way, in some embodiments, the function of the shutdown function turn-on sub-circuit 940 may be realized by using the above components, that is, the shutdown function turn-on sub-circuit 940 is coupled to the second node N2, the fourth node N4, and the shutdown function sub-circuit 930, so that the shutdown function sub-circuit 930 is indirectly coupled to the second node N2 and the fourth node N4 respectively, and the shutdown function turn-on sub-circuit 940 is configured to selectively cause a connection between the shutdown function sub-circuit 930 and the fourth node N4 to be turned on under control of the second node N2.

Specifically, for the optional shutdown function turn-on sub-circuit 940, during a phase to, since the second node N2 is at a low level, the fourth transistor T4 is turned off, so that the device voltage signal having a high level at the device voltage terminal DVDD is transmitted to the control terminal of the fifth transistor T5 after being subjected to an appropriate voltage drop through the fourth resistor R4 (in some other embodiments, the fourth resistor R4 may not be exist). In the embodiment shown in FIG. 9, the polarity type of the fifth transistor T5 is opposite to that of the fourth transistor (or other transistors in the shutdown circuit 900), and the fifth transistor T5 is, for example, a P-type transistor which is turned off at a high voltage. Therefore, the fifth transistor T5 is turned off, so that the shutdown function sub-circuit 930 does not operate.

During a period $t_1$, since the second node N2 is at a high level, the fourth transistor T4 is turned on, so that the control terminal of the fifth transistor T5 is directly grounded. Thereby, since the fifth transistor T5 is a P-type transistor which is turned on at a low voltage, the fifth transistor T5 is turned on, to transmit the high level signal at the fourth node N4 to the shutdown function sub-circuit 930, so that the shutdown function sub-circuit 930 starts to operate.

During a period $t_2$, since the second node N2 continues to be at a high level, the fourth transistor T4 continues to be turned on, so that the control terminal of the fifth transistor T5 continues to be grounded. Thereby, since the fifth transistor T5 is a P-type transistor which is turned on at a low voltage, the fifth transistor T5 is turned on, to transmit the higher level signal at the fourth node N4 to the shutdown function sub-circuit 930, so that the shutdown function sub-circuit 930 may continue to operate normally.

Hereinafter, a method for driving a shutdown circuit according to an embodiment of the present disclosure will be described in detail with reference to FIG. 10.

Figure 10:
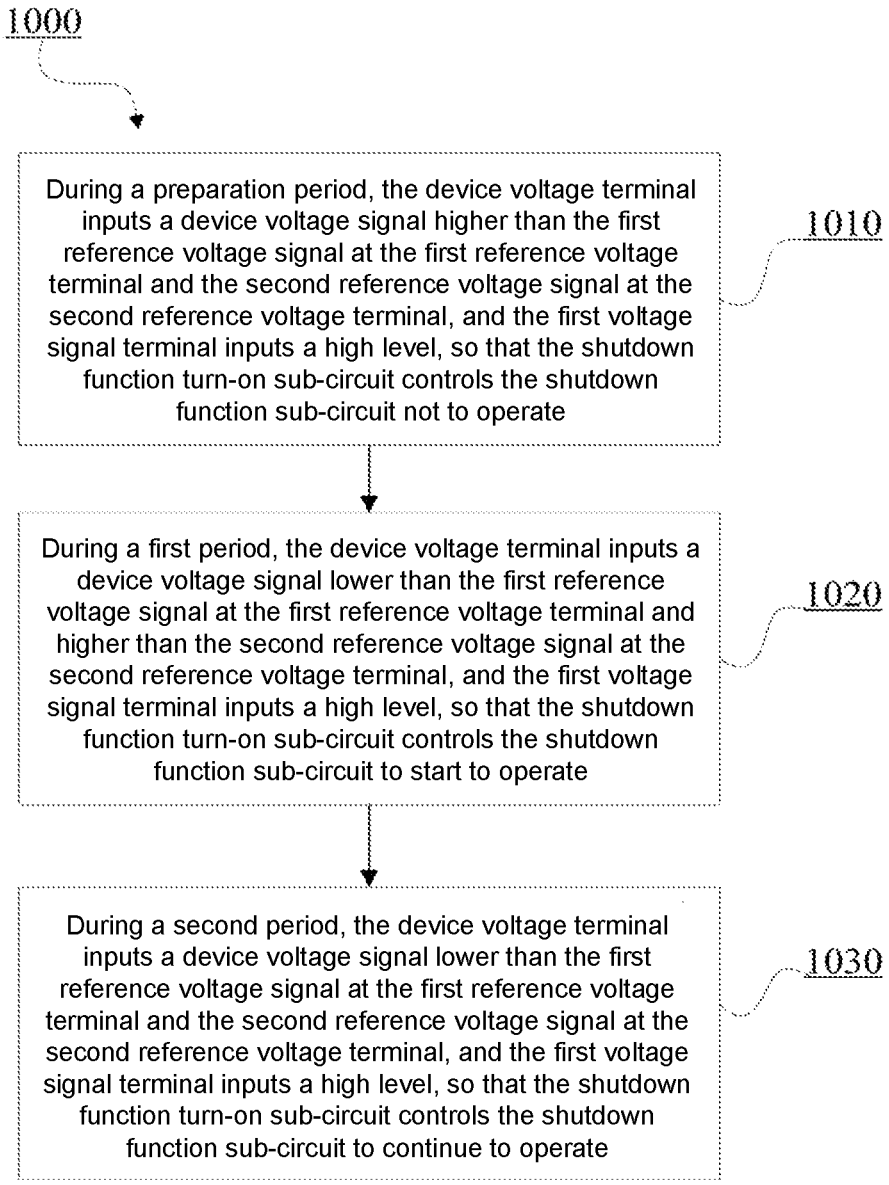
FIG. 10 is a flowchart illustrating an exemplary method for driving a shutdown circuit according to an embodiment of the present disclosure.

FIG. 10 is a flowchart illustrating an exemplary method 1000 for driving the shutdown circuits 700 and/or 900 according to an embodiment of the present disclosure. As shown in FIG. 10, the method 1000 may comprise steps S1010, S1020, and S1030. According to the present disclosure, some steps of the method 1000 may be performed individually or in combination, and may be performed in parallel or sequentially, and are not limited to a specific operation order shown in FIG. 10. In some embodiments, the method 1000 may be performed by each shutdown circuit described herein or another external device.

The method 1000 may start at step S1010. In step S1010, during a preparation period to, the device voltage terminal DVDD may input a device voltage signal higher than the first reference voltage signal at the first reference voltage terminal REF1 and the second reference voltage signal at the second reference voltage terminal REF2, and the first voltage signal terminal VGH may input a high level, so that the optional shutdown function turn-on sub-circuit 940 controls the shutdown function sub-circuit 930 not to operate.

In step S1020, during a first period $t_1$, the device voltage terminal DVDD may input a device voltage signal lower than the first reference voltage signal at the first reference voltage terminal REF1 and higher than the second reference voltage signal at the second reference voltage terminal REF2, and the first voltage signal terminal VGH may input a high level, so that the optional shutdown function turn-on sub-circuit 940 controls the shutdown function sub-circuit 930 to start to operate.

In step S1030, during a second period $t_2$, the device voltage terminal DVDD may input a device voltage signal lower than the first reference voltage signal at the first reference voltage terminal REF1 and the second reference voltage signal at the second reference voltage terminal REF2, and the first voltage signal terminal VGH may input a high level, so that the optional shutdown function turn-on sub-circuit 940 controls the shutdown function sub-circuit 930 to continue to operate.

With the above shutdown circuit and the method for driving the same according to the embodiments of the present disclosure, the residual charges of the panel may be effectively reduced, the afterimages/flicker during shutdown may be eliminated, and the utilization of the internal functions of the display may be improved. Specifically, the device voltage may be raised to a higher voltage during the shutdown under the bootstrap effect of the capacitor in the booster circuit in the shutdown circuit to ensure that subsequent shutdown functions (for example, an Xon function, a short-circuit between the data line and the common electrode etc.) are performed more sufficiently, and the function of the shutdown circuit is better completed, which completely solve the afterimage/flicker phenomenon during the shutdown, so that the transistors are turned on more fully, and there are less residual charges.

Figure 11:
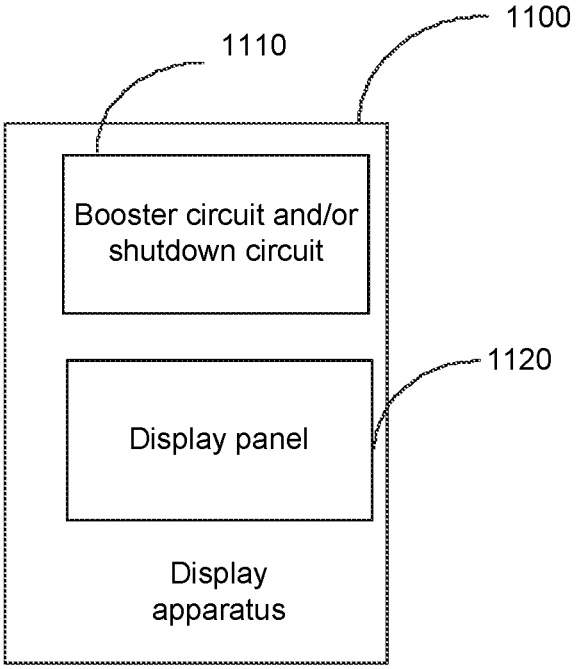
FIG. 11 is a schematic diagram illustrating an exemplary configuration of a display apparatus according to an embodiment of the present disclosure.

In addition, in some embodiments of the present disclosure, there is further provided a display apparatus. As shown in FIG. 11, the display apparatus 1100 may comprise the booster circuit and/or the shutdown circuit 1110 described above and a display panel 1120. It should be illustrated that the display apparatus in the present embodiment may be any product or component having a display function such as a display panel, an electronic paper, a mobile phone, a tablet computer, a television, a notebook computer, a digital photo frame, a navigator etc.

So far, the present disclosure has been described in conjunction with the preferred embodiments. It should be understood that those skilled in the art may make various other changes, substitutions, and additions without departing from the spirit and scope of the present disclosure. Therefore, the scope of the present disclosure is not limited to the specific embodiments described above, but should be defined by the appended claims.

In addition, functions described herein as being implemented by pure hardware, pure software, and/or firmware may also be implemented by a combination of dedicated hardware, general hardware, and software etc. For example, functions described as being implemented by dedicated hardware (for example, a Field Programmable Gate Array (FPGA), an Application Specific Integrated Circuit (ASIC), etc.) may be implemented by a combination of general purpose hardware (for example, a Central Processing Unit (CPU), a Digital Signal Processor (DSP)) and software, and vice versa.

We claim:

1. A booster circuit, comprising:

a first input sub-circuit coupled to a first input signal terminal, a first voltage signal terminal, and an output signal terminal, and configured to transmit a first voltage signal at the first voltage signal terminal to the output signal terminal under control of a first input signal at the first input signal terminal;

a second input sub-circuit coupled to a second input signal terminal, the first voltage signal terminal and a first node, and configured to transmit the first voltage signal at the first voltage signal terminal to the first node under control of a second input signal at the second input signal terminal; and a first storage sub-circuit coupled to the output signal terminal and the first node, and configured to cause a level of an output signal at the output signal terminal to be raised to a level higher than the first voltage signal, wherein the first input sub-circuit comprises a first transistor and a first diode, wherein:

the first transistor has a control terminal coupled to the first input signal terminal, a first terminal coupled to a cathode of the first diode, and a second terminal coupled to the output signal terminal, and the first diode has an anode coupled to the first voltage signal terminal.

2. The booster circuit according to claim 1, wherein the second input sub-circuit comprises:

a second transistor having a control terminal coupled to the second input signal terminal, a first terminal coupled to the first voltage signal terminal, and a second terminal coupled to the first node.

3. The booster circuit according to claim 1, wherein the first storage sub-circuit comprises:

a first capacitor having one terminal coupled to the output signal terminal and the other terminal coupled to the first node.

4. The booster circuit according to claim 2, wherein the second input sub-circuit further comprises:

a second diode having an anode coupled to the first voltage signal terminal and a cathode coupled to the first terminal of the second transistor, so that the first terminal of the second transistor is indirectly coupled to the first voltage signal terminal.

5. The booster circuit according to claim 2, further comprising:

a third transistor having a control terminal coupled to the output signal terminal, a first terminal coupled to the second terminal of the second transistor, and a second terminal coupled to the first node, so that the second terminal of the second transistor is indirectly coupled to the first node.

6. The booster circuit according to claim 1, further comprising a load sub-circuit, the load sub-circuit comprising:

a second capacitor having one terminal coupled to the first node, and the other terminal grounded; and a first resistor having one terminal coupled to the first node, and the other terminal grounded.

7. A method for driving the booster circuit according to claim 1, comprising:

during a preparation period, inputting a low level by the first input signal terminal, inputting a low level by the second input signal terminal, inputting a high level by the first voltage signal terminal, and outputting a low level by the output signal terminal;

during a first period, inputting a high level by the first input signal terminal, inputting a low level by the second input signal terminal, inputting a high level by the first voltage signal terminal, and outputting a high level by the output signal terminal; and during a second period, inputting a high level by the first input signal terminal, inputting a high level by the second input signal terminal, inputting a high level by the first voltage signal terminal, and outputting a level higher than the high level which is output at the output signal terminal during the first period by the output signal terminal.

8. A shutdown circuit, comprising:

a power-off detection sub-circuit coupled to a device voltage terminal, a first reference voltage terminal, a second reference voltage terminal, a second node and a third node, and configured to selectively cause a voltage at the second node to be at a high level or a low level under control of a device voltage signal at the device voltage terminal and a first reference voltage signal at the first reference voltage terminal, and configured to selectively cause a voltage at the third node to be at a high level or a low level under control of the device voltage signal at the device voltage terminal and a second reference voltage signal at the second reference voltage terminal;

the booster circuit according to claim 1; and a shutdown function sub-circuit coupled to a fourth node and configured to perform shutdown-related functions under control of the fourth node.

9. The shutdown circuit according to claim 8, wherein the power-off detection sub-circuit comprises:

a first comparator having a first input terminal coupled to the device voltage terminal, a second input terminal coupled to the first reference voltage terminal, and an output terminal coupled to the second node, and configured to cause a low level signal to be output from the output terminal of the first comparator in a case where a voltage of the device voltage signal at the device voltage terminal is higher than that of the first reference voltage signal at the first reference voltage terminal, so that the voltage at the second node becomes a low level, and cause a high level signal to be output from the output terminal of the first comparator in a case where the voltage of the device voltage signal at the device voltage terminal is lower than or equal to that of the first reference voltage signal at the first reference voltage terminal, so that the voltage at the second node becomes a high level; and a second comparator having a first input terminal coupled to the device voltage terminal, a second input terminal coupled to the second reference voltage terminal, and an output terminal coupled to the third node, and configured to cause a low level signal to be output from the output terminal of the second comparator in a case where the voltage of the device voltage signal at the device voltage terminal is higher than that of the second reference voltage signal at the second reference voltage terminal, so that the voltage at the third node becomes a low level, and cause a high level signal to be output from the output terminal of the second comparator in a case where the voltage of the device voltage signal at the device voltage terminal is lower than or equal to that of the second reference voltage signal at the second reference voltage terminal, so that the voltage at the third node becomes a high level.

10. The shutdown circuit of claim 9, wherein the power-off detection sub-circuit further comprises:

a second resistor having one terminal coupled to the device voltage terminal, and the other terminal coupled to the respective first input terminals of the first comparator and the second comparator, so that the respective first input terminals of the first comparator and the second comparator are indirectly coupled to the device voltage terminal; and a third resistor having one terminal grounded and the other terminal coupled to the respective first input terminals of the first comparator and the second comparator.

11. The shutdown circuit according to claim 8, wherein the shutdown function sub-circuit comprises at least one of:

a short-circuit sub-circuit configured to selectively realize a short-circuit between a data line and a common electrode of an associated display driving circuit under control of the fourth node; or a discharging sub-circuit configured to cause driving transistors in associated one or more pixel circuits to be turned on under control of the fourth node.

12. The shutdown circuit according to claim 8, further comprising:

a shutdown function turn-on sub-circuit coupled to the second node, the fourth node, and the shutdown function sub-circuit, so that the shutdown function sub-circuit is indirectly coupled to the second node and the fourth node respectively, and configured to selectively cause a connection between the shutdown function sub-circuit and the fourth node to be turned on under control of the second node.

13. The shutdown circuit according to claim 12, wherein the shutdown function turn-on sub-circuit comprises a fourth transistor, a fourth resistor, and a fifth transistor, wherein the fourth transistor has a control terminal coupled to the second node, a first terminal coupled to a control terminal of the fifth transistor, and a second terminal grounded;

the fourth resistor has one terminal coupled to the device voltage terminal, and the other terminal coupled to the control terminal of the fifth transistor; and the fifth transistor having a first terminal coupled to the fourth node, and a second terminal coupled to the shutdown function sub-circuit, wherein a polarity type of the fifth transistor is opposite to that of the fourth transistor.

14. A method for driving the shutdown circuit according to claim 8, comprising:

during a preparation period, inputting a device voltage signal higher than the first reference voltage signal at the first reference voltage terminal and the second reference voltage signal at the second reference voltage terminal by the device voltage terminal, and inputting a high level by the first voltage signal terminal, so that the shutdown function sub-circuit does not operate;

during a first period, inputting a device voltage signal lower than the first reference voltage signal at the first reference voltage terminal and higher than the second reference voltage signal at the second reference voltage terminal by the device voltage terminal, and inputting a high level by the first voltage signal terminal, so that the shutdown function sub-circuit starts to operate; and during a second period, inputting a device voltage signal lower than the first reference voltage signal at the first reference voltage terminal and the second reference voltage signal at the second reference voltage terminal by the device voltage terminal, and inputting a high level by the first voltage signal terminal, so that the shutdown function sub-circuit continue to operate.

15. A display apparatus, comprising a display panel and the shutdown circuit according to claim 8.

16. A booster circuit, comprising:

a first transistor having a control terminal coupled to a first input signal terminal, and a second terminal coupled to an output signal terminal;

a first diode having an anode coupled to a first voltage signal terminal, and a cathode coupled to a first terminal of the first transistor;

a second transistor having a control terminal coupled to a second input signal terminal, a first terminal coupled to the first voltage signal terminal, and a second terminal coupled to a first node;

a first capacitor having one terminal coupled to the output signal terminal and the other terminal coupled to the first node;

a second diode having an anode coupled to the first voltage signal terminal and a cathode coupled to the first terminal of the second transistor, so that the first terminal of the second transistor is indirectly coupled to the first voltage signal terminal;

a third transistor having a control terminal coupled to the output signal terminal, a first terminal coupled to the second terminal of the second transistor, and a second terminal coupled to the first node, so that the second terminal of the second transistor is indirectly coupled to the first node;

a second capacitor having one terminal coupled to the first node, and the other terminal grounded; and a first resistor having one terminal coupled to the first node, and the other terminal grounded.

* * * * *